US005191231A

United States Patent [19]

Berry

[11] Patent Number: 5,191,231

[45] Date of Patent: Mar. 2, 1993

[54] TIMER FOR ELECTRICAL APPLIANCES

[76] Inventor: Woodrow Berry, 1678 Givan Ave., Bronx, N.Y. 10469

[21] Appl. No.: 693,813

[22] Filed: Apr. 30, 1991

[51] Int. Cl.[5] ..... H01H 43/01

[52] U.S. Cl. ..... 307/142; 307/66; 307/141.4; 358/349

[58] Field of Search ..... 307/64, 66, 139, 140, 307/141, 141.4, 142, 143; 358/349

[56] References Cited

U.S. PATENT DOCUMENTS

| | | | |
|---|---|---|---|
| 3,388,308 | 6/1968 | Fontaine | 318/467 |
| 3,581,029 | 5/1971 | Noiles | 307/141 |
| 3,833,779 | 9/1974 | Leone | 200/33 R |
| 3,879,332 | 4/1975 | Leone | 200/33 R |
| 4,075,506 | 2/1978 | Nakata | 307/117 |
| 4,198,551 | 4/1980 | Peterson | 200/33 R |
| 4,246,495 | 1/1981 | Pressman | 307/141 |
| 4,279,012 | 7/1981 | Beckedorff et al. | 307/141.4 |
| 4,566,033 | 1/1986 | Reidenouer | 358/349 |
| 4,588,901 | 5/1986 | Maclay et al. | 307/141 |
| 4,624,578 | 11/1986 | Green | 368/10 |
| 4,712,019 | 12/1987 | Nilssen | 307/141 |
| 4,719,364 | 1/1988 | Pequet et al. | 307/141 |
| 4,769,765 | 9/1988 | Green | 235/382 |
| 4,814,901 | 3/1989 | Onishi et al. | 360/33.1 |

*Primary Examiner*—Jeffrey A. Gaffin
*Attorney, Agent, or Firm*—Mark P. Stone

[57] ABSTRACT

The present invention provides an improved timer device for programming pre-selected time periods during which an electrical appliance can be actuated or deactuated at the selection of the user, or during which the appliance is in a non-operational state. The timer device is particularly adapted for use in conjunction with a television set for providing time periods during which children or other persons may view television at their option, and other time periods during which power to the television is cut-off and the television cannot be viewed. The timer includes a back-up power supply, particularly a battery pack, for maintaining the timer in its operational condition in the event that line power to the electrical appliance is interrupted or otherwise disrupted.

14 Claims, 1 Drawing Sheet

TIMER FOR ELECTRICAL APPLIANCES

BACKGROUND OF THE INVENTION

The present invention is directed generally to timer devices for electrical appliances for programming pre-selected time periods during which the appliance may be actuated at the selection of the user, and for providing other time periods during which the appliance cannot be actuated. The timer device is particularly useful in connection with a television set to regulate television viewing time for children and other persons.

It is not uncommon for children to be left on their own during various times of the day, particularly after school, before their parents return from work. During such time periods, it is desirable that the children primarily attend to completing their homework or other chores, and not spending a substantial amount of their time viewing television. Accordingly, known timer or programming devices have been developed for providing pre-selected time periods during which a television is de-energized and cannot be actuated by a user, and other time periods during which the television set is energized and can be actuated at the selection of the user. In this manner, a television set may be programmed so that it may be selectively actuated and viewed by children either during only pre-selected time periods of the day, or for only a pre-determined total time within, for example, a twenty-four (24) hour time period. Accordingly, a parent can control the television viewing time of a child even if the child is left alone with a television set accessible to him.

Typical known devices for regulating viewing time of televisions, or for regulating the energization time of other electrical appliances, are disclosed by the following exemplary patents: U.S. Pat. No. 3,833,779, issued on Sep. 3, 1974 to Leone; U.S. Pat. No. 4,624,578, issued on Nov. 25, 1986 to Green; U.S. Pat. No. 3,879,332, issued on Apr. 22, 1975 to Leone; U.S. Pat. No. 3,388,308, issued on Jun. 11, 1968 to Fontaine; U.S. Pat. No. 4,246,495, issued on Jan. 20, 1981 to Pressman; U.S. Pat. No. 4,588,901, issued on May 13, 1986, issued to Maclay et al; U.S. Pat. No. 4,075,506, issued on Feb. 21, 1978 to Makata; U.S. Pat. No. 4,198,551 issued on Apr. 15, 1980 to Peterson; U.S. Pat. No. 4,279,012, issued on Jul. 14, 1981 to Beckedorff et al; U.S. Pat. No. 4,566,033, issued on Jan. 21, 1986 to Reidenouer; U.S. Pat. No. 4,769,765, issued on Sep. 6, 1988 to Green; and U.S. Pat. No. 4,814,901, issued on Mar. 21, 1989 to Onishi et al. The aforementioned U.S. Pat. Nos. 3,833,779; 4,624,578; 3,879,332; and 4,246,495, are illustrative of timer devices for television sets which are intended to limit or restrict television viewing time.

It is the primary object of the present invention to provide an improved timer device for use in connection with electrical appliances, particularly television sets, for selectively limiting the time of the day, or the total time during a day, during which television can be viewed. The improvement provided by the present invention includes a back-up electrical power supply for the timer device which is automatically actuated upon disruption or interruption of line power to the timer device and the television set for maintaining the timer device in its operational or functional state.

Other objects and advantages of the present invention will become apparent from the following discussion in conjunction with the drawings.

SUMMARY OF THE INVENTION

The present invention provides a timer device adapted to be electrically coupled to an electrical appliance, and in particular a television set, for restricting the time during which the television set or other electrical appliance can be selectively actuated by a user. The preferred embodiment of the invention provides a modular timer device which is electrically coupled to the appliance on one end, and electrically coupled to a source of electrical line power on the other end. In this manner, the timer device of the present invention may be adapted for use with pre-existing television sets or other appliances not equipped with timing devices. Although the preferred embodiment of the invention is a modular timer unit independent of the television set or appliance itself, the present invention may also be integrally installed within the appliance itself when the appliance is initially manufactured.

The timer device of the present invention programs or controls time periods during which a television set may be actuated at the selection of a viewer, and further programs or controls times during which line power to the television set is cut off and the set may not be actuated by a viewer. The timer device includes a back-up electrical power supply, in particular a battery pack, which is electrically coupled to a timer element through an electrical relay. Under normal operating conditions, the timer device is energized by line power, the same power which energizes the television set when it is actuated. However, in the event that line power is interrupted or disrupted, the relay switches the back-up power supply into electrical circuit with the timer device, which thereafter continues to operate normally to continue to control television viewing time. In this manner, the timer cannot be overridden by merely removing the electrical plug from the line outlet to temporarily disrupt power to the timer and cause the timer to cut off, and thereafter plugging the electrical cord of the appliance back into the wall outlet, as might be attempted by a child attempting to de-actuate the timer to view the television set during a restricted time period. The resumption of line power causes the relay to electrically disconnect the back-up power supply from the timer element, and the timer element then resumes continued normal operation on line power. A battery charging device, which is coupled to line power on one end and is electrically coupled to the back-up power supply on the other end, may be provided to maintain the back-up power supply in a continuous operational state.

Although the preferred embodiment of the timer device of the present invention is provided as a separate module which can be adapted for use with pre-existing appliances and television sets, the timer of the present invention may also be integrally manufactured within a new television set or other appliance by the original equipment manufacturer.

DESCRIPTION OF THE BEST MODES FOR CARRYING OUT THE INVENTION

Figure 1:
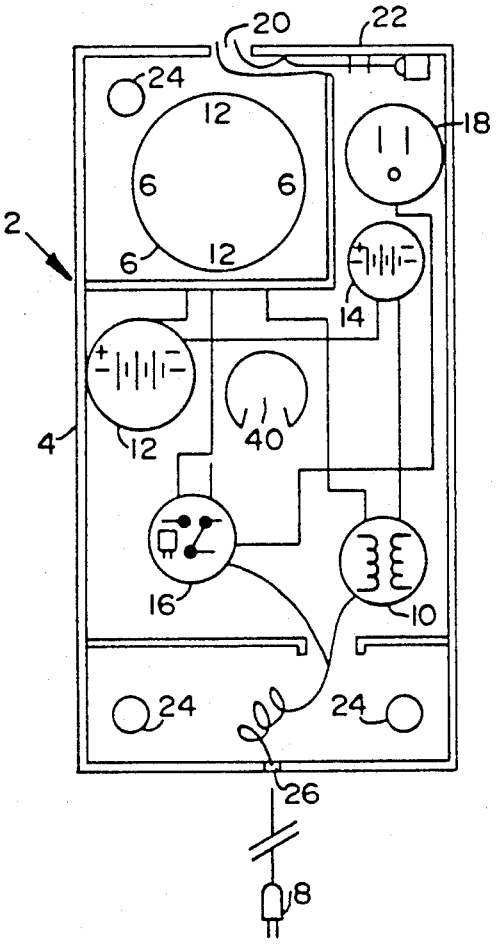
FIG. 1 of the drawing illustrates a sectional view of a timer device in accordance with the present invention.

The preferred embodiment of the present invention will now be described with reference to FIGS. 1-5 of the drawing.

FIG. 1 of the drawing illustrates, in section, a timer device generally designated by reference numeral 2 having an enclosure or housing 4. The timer device includes a conventional, adjustable timer element 6 within the housing and electrically coupled to receive line power from an electrical wall outlet through an electrical plug 8 and a transformer 10. The timer element 6 is further electrically coupled to an outlet 18 within the housing 4, which receives a plug from an electrical appliance to be controlled, through an electrical relay 6. Accordingly, an electrical circuit between the line power and the appliance to be controlled, is completed through the timer element 6.

A further circuit electrically couples a back-up electrical power supply 12 within the housing 4 to the timer element 6. The back-up electrical power supply, which can be a battery pack, is electrically coupled to a battery charger 14, also enclosed within the housing 4. The battery charger 14 is electrically coupled to the line power through the plug 8 and the transformer 10 to continually charge the back-up power supply at all times when line current is available.

As will be discussed in greater detail below, the electrical relay 16 in addition to electrically coupling the appliance outlet 18 to receive power from the timer element 6, also automatically electrically couples the back-up power supply 12 to the timer element 6 in the event of disruption or interruption of the line current.

An opening 20 is provided in the housing 4 for the passage of an electrical cord of the appliance. Cord retainer means 22, such as clips, are provided for securing the electrical cord of the appliance within the housing. A channel 40 is provided in the housing for receiving electrical cords and wires, as more fully discussed herein with respect to FIG. 5.

The housing 4 further includes suitable mounting openings 24 for mounting the housing over a conventional electrical wall outlet. A second opening 26 is provided in the housing 4 for receiving an electrical cord for electrically coupling the components within the housing to a wall outlet through the electrical plug 8.

Figure 2:
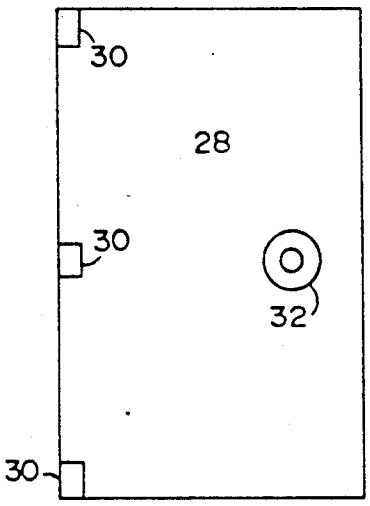
FIG. 2 illustrates a front elevational view of the front surface of a housing for the timer device of FIG. 1.

FIG. 2 of the drawing illustrates a front elevational view of the timer device 2, as seen when mounted in an operational position over an electrical wall outlet. The housing is closed by a front cover 28, which is mounted to the housing 4 by hinges 30. A keyhole opening 32 is provided in the front cover 28 for locking and unlocking the housing so that it may be selectively opened to set or adjust the timer element 6.

Figure 3:
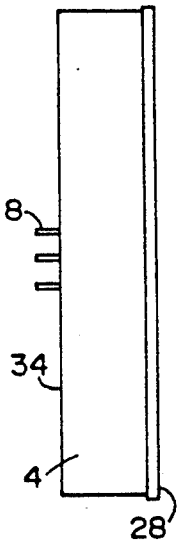
FIG. 3 illustrates a side elevational view of the housing of FIG. 2.

FIG. 3 of the drawing illustrates a side elevational view of the housing 4 with the front cover 28 mounted thereon in its closed position. The electrical plug 8, adapted to electrically couple the timer device 2 to a wall outlet, is shown extending from a rear surface 34 of the housing 4.

Figure 4:
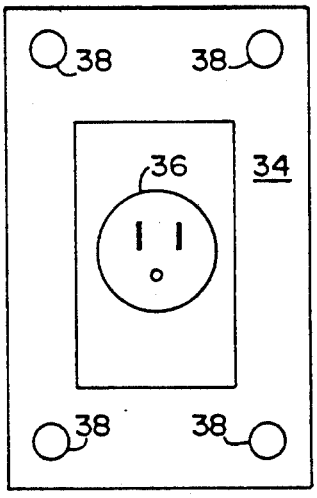
FIG. 4 illustrates mounting means for mounting the housing of FIG. 3 over a conventional wall outlet.

FIG. 4 illustrates a front elevational view of the rear surface 34 of the housing, shown in FIG. 3. The rear surface 34 provides a frame-like structure to be mounted around a conventional wall outlet 36 through mounting openings 38 provided proximate to the corners of the rear surface.

Figure 5:
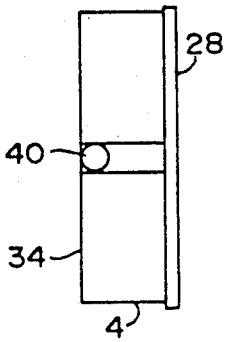
FIG. 5 illustrates a side elevational view of the housing of FIG. 2, cut away in portion, to illustrate a channel for accommodating electrical cords connected to the timer device of FIG. 1.

FIG. 5 schematically illustrates a side elevational view of the timer device 2 showing a channel 40 adapted to receive electrical cords and wires entering and leaving the housing 4 for electrically coupling the timer element 6 within the housing to an electrical wall outlet, or for electrically coupling the timer element to the electrical cord of an appliance to be regulated.

In operation of the invention, an electrical cord from an electrical appliance to be controlled by the timer device, such as a television set, is received within the housing 4 and plugged into the outlet 18 therein. Similarly, the housing 4 is electrically coupled to a conventional electrical wall outlet or other source of line power via electrical plug 8. The electrical line power feeds the timer element 6, and simultaneously feeds the battery charger 14, through the transformer 10. Thus under normal operating conditions, the timer element 6 is electrically coupled to the appliance outlet 18 through the relay 16 for powering the appliance outlet when the timer element is programmed to do so.

The electrical relay 16 is also directly coupled to the line current through the electrical plug 8. Any discontinuance or disruption in the flow of line current is detected by the relay 16 which monitors the line current, and the relay 16 responds by automatically switching the back-up power supply 12 into direct electrical connection with the timer element 6. (To the contrary, during normal operation of the system from the line current, the relay 16 assures that the back-up power supply 12 is not electrically coupled to the timer element 6, but is electrically coupled only to the battery charger 14). When the relay 16 senses resumption of normal line power, it automatically electrically couples the line power back to the timer element 6, while electrically disconnecting the back-up power supply 12 from the timer element 6.

Accordingly, the timer element 6 is always in operation, because it is either directly driven by the line current when line current is available, or it is driven by the back-up electrical power supply in the event of discontinuance or disruption of normal line current. A child attempting to override the timer element by unplugging the plug 8 to disconnect the timer device 6 from the wall outlet, and thereafter reconnecting it to line power, will not succeed since the timer element will remain operational and energized by the back-up electrical power supply during the time period in which the device remains disconnected from line current.

Although the preferred embodiment of the invention describes the timer device as a separate module independent of the appliance to be controlled, it is within the scope of the invention to provide the timer device integrally within such appliance. However, the separate modular embodiment of the invention is preferred since it may be adapted for use with pre-existing electrical appliances not including a factory installed timer device.

Although the preferred embodiment of the invention has been described as being used primarily for controlling viewing time of a television set, it may also be advantageously used in the same manner to control the operating time of any electrical appliance.

Other modifications and variations within the scope of the present invention will become apparent to those skilled in the art. Accordingly, the description of the preferred embodiment provided herein is intended to be illustrative only, and not restrictive of the scope of the invention, that scope being defined by the following claims and all equivalents thereto.

I claim:

1. An apparatus for providing continuous electrical power to a timer device for controlling operational use time of an electrical appliance, said apparatus comprising:

a housing, a timer element within said housing, means within said housing for electrically connecting an electrical appliance to a source of electrical line current through said timer element, a back-up electrical power supply within said housing, said back-up electrical power supply being selectively electrically connected to said timer element, and electrical switch means coupled to said timer element and responsive to said source of electrical line current for electrically connecting said back-up power supply to said timer element in response to at least a predetermined decrease in line current such that said timer element is continuously energized to control the operation of said electrical appliance.

2. The apparatus as claimed in claim 1 further including transformer means electrically connected between said source of line current and said timer element.

3. The apparatus as claimed in claim 1 wherein said electrical power supply is a battery, and said timer device further includes means for re-charging said battery, said means for re-charging said battery being electrically coupled to said electrical power supply.

4. The apparatus of claim 1 wherein said device is a separate module adapted to being coupled to an electrical appliance.

5. The apparatus of claim 1 wherein said device is adapted to being integrally mounted within an electrical appliance.

6. The apparatus as claimed in claim 1 including a transformer electrically connected between said timer element and said source of line current, said timer device further including a battery charger electrically coupled to said electrical power supply, said transformer being electrically disposed between said battery charger and said source of line current.

7. The apparatus as claimed in claim 1 wherein said electrical switch means comprises an electrical relay.

8. An apparatus for providing continuous electrical power to a television set for controlling operational use time of said television set, said apparatus comprising:

a housing, a timer element within said housing, means within said housing for electrically connecting said television set to a source of electrical line current through said timer element, a back-up electrical supply within said housing, said back-up electrical power supply being selectively electrically connected to said timer element, and electrical switch means coupled to said timer element and responsive to said source of electrical line current for electrically connecting said back-up power supply to said timer element in response to at least a predetermined decrease in line current such that said timer element is continuously energized to control the operation of said television set.

9. The apparatus as claimed in claim 8 further including transformer means electrically connected between said source of line current and said timer element.

10. The apparatus as claimed in claim 8 wherein said electrical power supply is a battery, and said timer device further includes means for recharging said battery, said means for recharging said battery being electrically coupled to said electrical power supply.

11. The apparatus of claim 8 wherein said device is a separate module adapted to being coupled to a television set.

12. The apparatus of claim 8 wherein said device is adapted to being integrally mounted within a television set.

13. The apparatus as claimed in claim 8 including a transformer electrically connected between said timer element and said source of line current, said timer device further including a battery charger electrically coupled to said electrical power supply, said transformer being electrically disposed between said battery charger and said source of line current.

14. The apparatus as claimed in claim 8 wherein said electrical switch means comprises an electrical relay.

* * * * *